US008699740B2

(12) United States Patent
Chiang et al.

(10) Patent No.: US 8,699,740 B2
(45) Date of Patent: Apr. 15, 2014

(54) HEADPHONE SOUND-GENERATING STRUCTURE AND METHOD OF ASSEMBLING SAME

(75) Inventors: Hsin-Yuan Chiang, Taoyuan County (TW); Chuan-Chun Ma, Taoyuan County (TW)

(73) Assignee: Fortune Grand Technology Inc., Taoyuan County (TW)

( * ) Notice: Subject to any disclaimer, the term of this patent is extended or adjusted under 35 U.S.C. 154(b) by 339 days.

(21) Appl. No.: 13/189,202

(22) Filed: Jul. 22, 2011

(65) Prior Publication Data

US 2013/0022225 A1 Jan. 24, 2013

(51) Int. Cl.
*H04R 25/00* (2006.01)

(52) U.S. Cl.
USPC ..... 381/371; 381/370; 381/374; 29/594

(58) Field of Classification Search
USPC ..... 381/371, 370, 374
See application file for complete search history.

(56) References Cited

U.S. PATENT DOCUMENTS 3,612,778 A * 10/1971 Murphy ..... 381/191
3,894,333 A * 7/1975 Chang ..... 29/594
3,942,029 A * 3/1976 Kawakami et al. ..... 381/191
5,229,979 A * 7/1993 Scheinbeim et al. ..... 29/25.35

* cited by examiner

*Primary Examiner* — Duc Nguyen
*Assistant Examiner* — Taunya McCarty
(74) *Attorney, Agent, or Firm* — WPAT, P.C.; Anthony King; Kay Yang

(57) ABSTRACT

A headphone sound-generating structure includes a sound-generating module and a plurality fastening elements. The sound-generating module includes a first perforated plate, a first ring-shaped spacer, a diaphragm assembly, a second ring-shaped spacer, a second perforated plate, and a second ring-shaped mounting frame, which are sequentially superposed in a receiving space defined on an ear cup. The fastening elements are extended through third mounting holes of the second ring-shaped mounting frame and fourth mounting holes of the ear cup to thereby quickly secure the sound-generating module to the ear cup to complete a headphone sound-generating structure, which can be manufactured at lowered cost and increased good yield, and allows convenient maintenance without wasting any material. A method of assembling the headphone sound-generating structure is also introduced.

6 Claims, 10 Drawing Sheets

HEADPHONE SOUND-GENERATING STRUCTURE AND METHOD OF ASSEMBLING SAME

FIELD OF THE INVENTION

The present invention relates to a headphone sound-generating structure, and more particularly to a headphone sound-generating structure that can be quickly assembled at lowered cost and increased good yield, and can be conveniently maintained without wasting any material. The present invention also relates to a method of assembling the above headphone sound-generating structure.

BACKGROUND OF THE INVENTION

Many people would wear headphones to listen to music. Differently configured headphones are available, such as in-ear headphones, clip-on earphones, and headband headphones.

Headphones can also be classified according to the technical methods they employed to reproduce or generate sound. For example, there is a type of electrostatic headphones, which can be further divided into DC-bias voltage headphones and electret headphones according to the working principle thereof. According to the working principle of the DC-bias voltage headphones, a DC (direct current) bias voltage is continuously applied across each of the diaphragms of the headphones, so that charges are distributed over the entire diaphragm; meanwhile, two AC (alternating current) voltages of opposite phases are synchronously and continuously applied across two perforated metal plates located at two opposite sides of the diaphragm. Electrostatic forces produced by positive and negative charges bring the diaphragm to vibrate and output sound. On the other hand, according to the working principle of the electret headphones, the diaphragms thereof are charged before product assembling, so that charges are distributed on the diaphragms and it is not necessary to apply any DC bias voltage signal across the diaphragms when using the electret headphones; meanwhile, two AC (alternating current) voltages of opposite phases are synchronously and continuously applied across two perforated metal plates located at two opposite sides of the diaphragm. Electrostatic forces produced by positive and negative charges bring the diaphragm to vibrate and output sound. Since the working principles of the DC-bias voltage headphones and the electret headphones are known to those skilled in the art, they are not discussed in details herein.

Conventionally, the sound-generating assemblies for electrostatic headphones are manufactured by hot-press molding. That is, the diaphragms, spacers, perforated plates, and other external components, such as ear cups, included in the electrostatic headphones for generating sound are completely assembled by hot-press molding. However, while the hot-press molding process enables automated and efficient production, the hot-press molded sound-generating assemblies do not allow disassembling for the purpose of replacing any components that are found defective in a sound quality test. The hot-press molded sound-generating assemblies, once disassembled, would become entirely unusable. As it is known, the diaphragms used in the electrostatic headphones are very expensive. It is apparently not economical if the expensive diaphragms are discarded along with other components when the hot-press molded sound-generating assemblies fail to pass the sound quality test. Therefore, the conventional sound-generating assemblies for electrostatic headphones manufactured by hot-press molding disadvantageously have risks of high assembling and manufacturing costs and could not be conveniently maintained or repaired.

It is therefore tried by the inventor to develop a headphone sound-generating structure and a method of assembling same, so that the headphone sound-generating structure can be quickly assembled at lowered cost and increased good yield, and can be conveniently maintained without wasting any material.

SUMMARY OF THE INVENTION

A primary object of the present invention is to provide a headphone sound-generating structure that can be quickly assembled using fastening elements to achieve the advantages of lowered cost, increased good yield, and convenient maintenance without wasting any material.

Another object of the present invention is to provide a method of assembling the above headphone sound-generating structure.

To achieve the above and other objects, the headphone sound-generating structure according to the present invention is configured for mounting in a receiving space defined on an ear cup, which is provided with a plurality of fourth mounting holes. The headphone sound-generating structure includes a sound-generating module and a plurality of fastening elements. The sound-generating module includes a first perforated plate, a first ring-shaped spacer, a diaphragm assembly, a second ring-shaped spacer, a second perforated plate, and a second ring-shaped mounting frame, which are sequentially superposed in the receiving space defined on the ear cup. The fastening elements are extended through third mounting holes of the second ring-shaped mounting frame and fourth mounting holes of the ear cup to thereby secure the sound-generating module to the ear cup to complete the headphone sound-generating structure.

To achieve the above and other objects, the method according to the present invention for assembling the above-described headphone sound-generating structure includes the steps of superposing a first perforated plate on an ear cup within a receiving space defined on the ear cup; superposing a first ring-shaped spacer on the first perforated plate; superposing a diaphragm assembly on the first ring-shaped spacer; superposing a second ring-shaped spacer on the diaphragm assembly; superposing a second perforated plate on the second ring-shaped spacer; superposing a second ring-shaped mounting frame on the second perforated plate; and using a plurality of fastening elements to secure the second ring-shaped mounting frame to the ear cup.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with a preferred embodiment thereof and with reference to the accompanying drawings.

Figure 1:
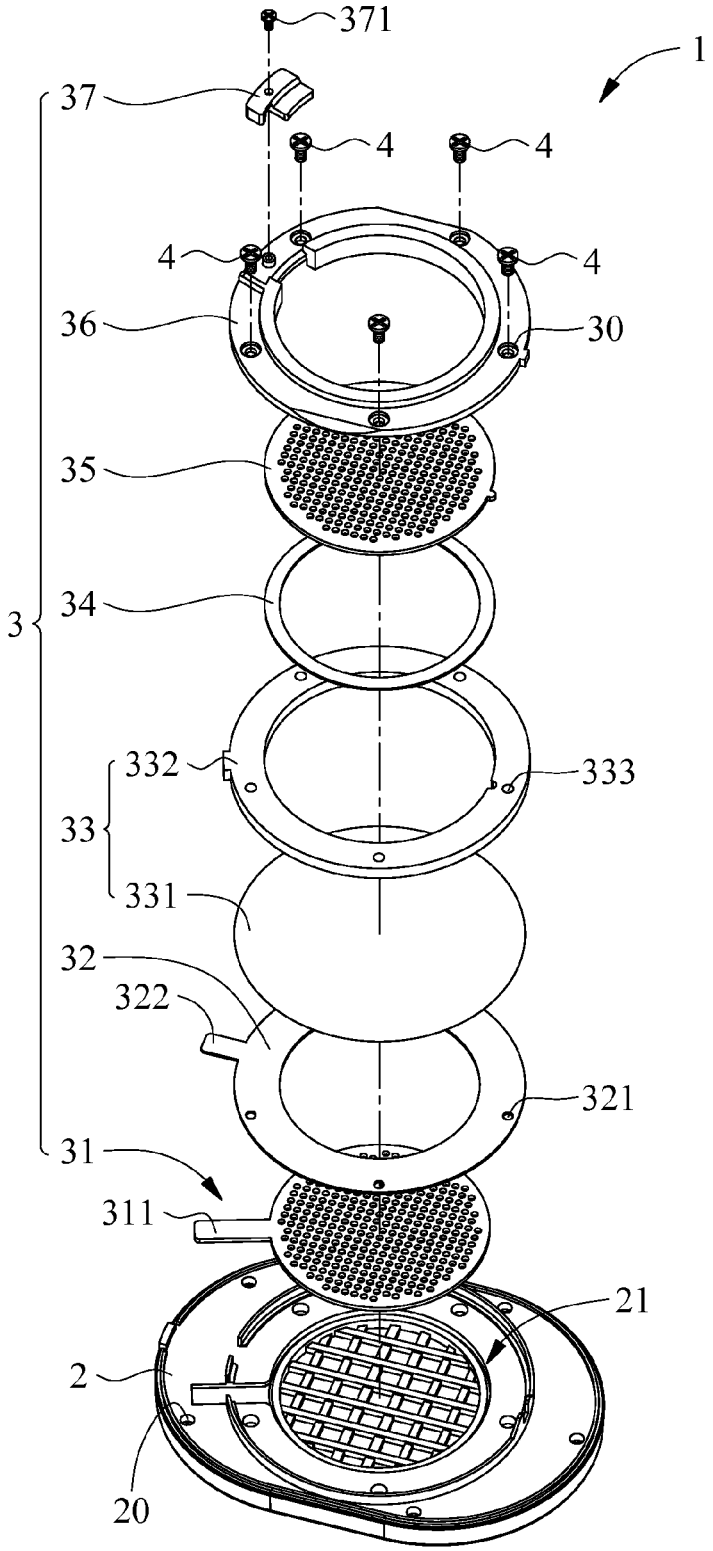
FIG. 1 is an exploded perspective view of a headphone sound-generating structure according to an embodiment of the present invention.
Figure 2:
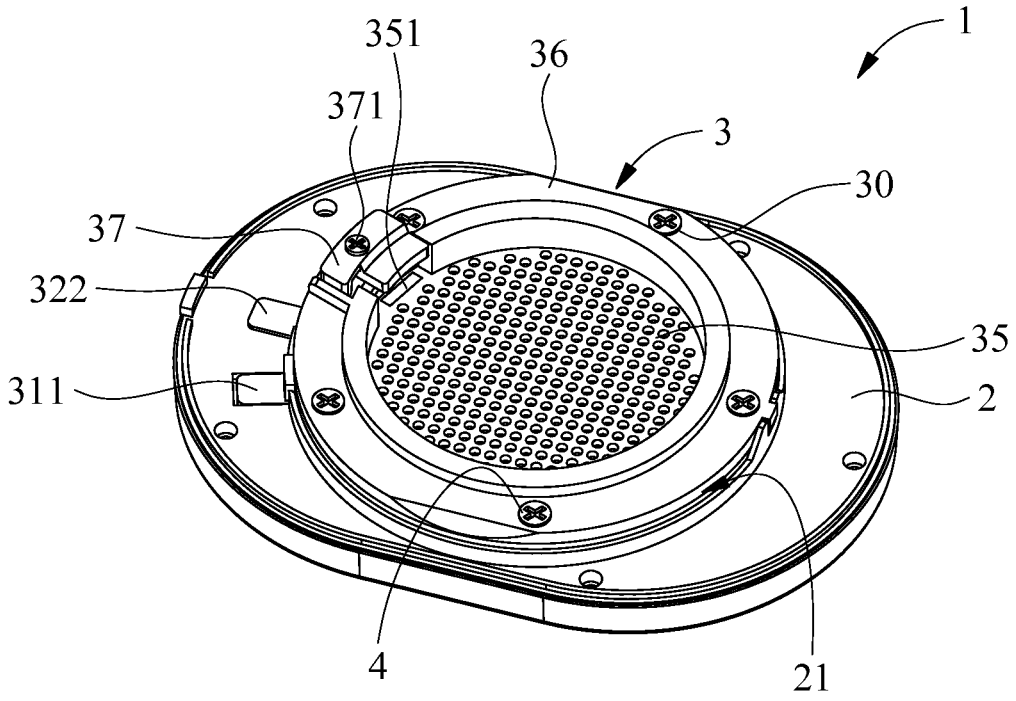
FIG. 2 is an assembled view of FIG. 1.
Figure 3:
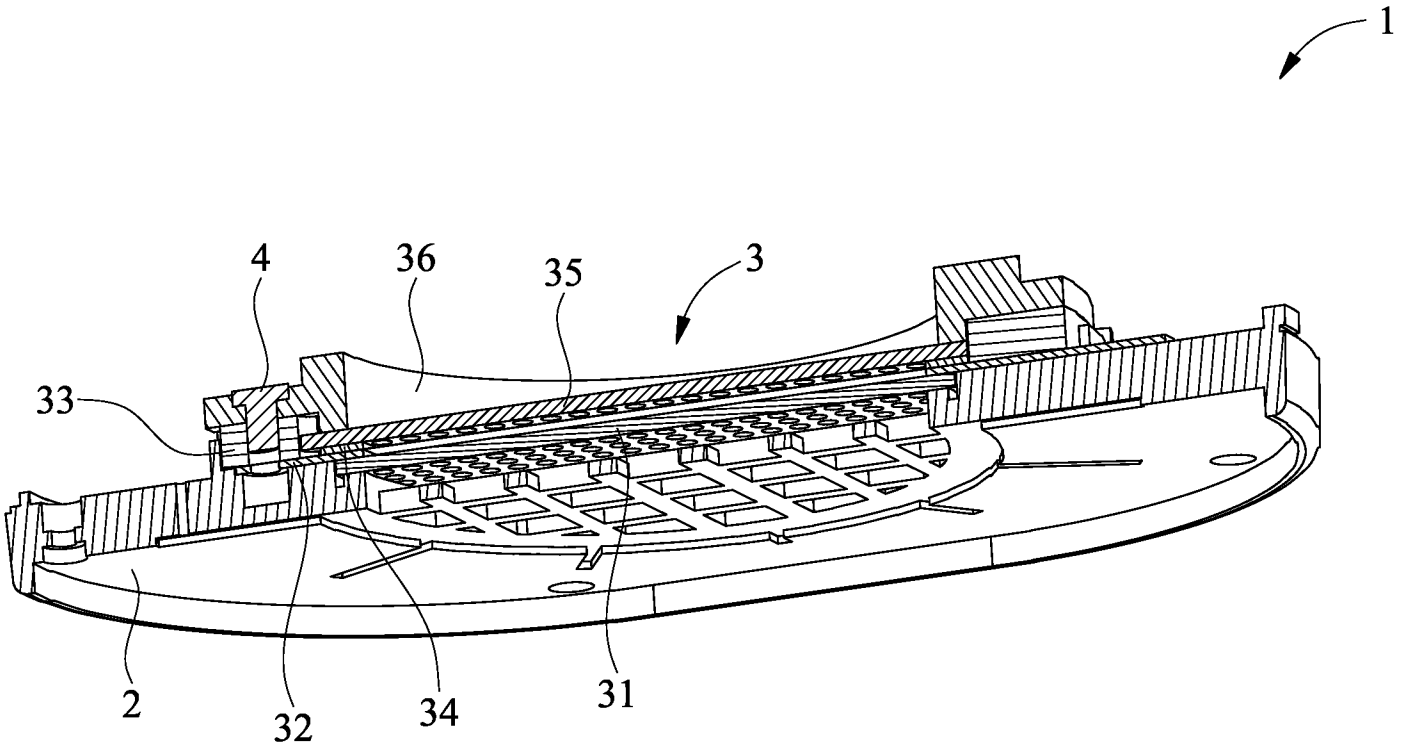
FIG. 3 is a cutaway view of FIG. 2.

Please refer to FIGS. 1 and 2 that are exploded and assembled perspective views, respectively, of a headphone sound-generating structure 1 according to an embodiment of the present invention, and to FIG. 3 that is a cutaway view of FIG. 2.

As shown, the headphone sound-generating structure 1 is configured for mounting in a receiving space 21 defined on an ear cup 2, and includes a sound-generating module 3 and a plurality of fastening elements 4. On the ear cup 2, there is provided a plurality of fourth mounting holes 20.

The fourth mounting holes 20 are located in and spaced along an outer periphery of the receiving space 21. The sound-generating module 3 includes a first perforated plate 31, a first ring-shaped spacer 32, a diaphragm assembly 33, a second ring-shaped spacer 34, a second perforated plate 35, and a second ring-shaped mounting frame 36, which are sequentially superposed on the ear cup 2 in the receiving space 21 thereof. The second ring-shaped mounting frame 36 is provided with a plurality of third mounting holes 30. The fastening elements 4 are extended through the third mounting holes 30 of the second ring-shaped mounting frame 36 and the fourth mounting holes 20 of the ear cup 2 to thereby secure the sound-generating module 3 to the ear cup 2.

According to the present invention, by assembling the sound-generating module 3 to the ear cup 2 with fastening elements 4, the headphone sound-generating structure 1 can be produced at reduced time and labor costs and increased good yield, and can be conveniently maintained without wasting any material. For example, when the sound-generating module 3 having been assembled to the ear cup 2 does not pass a sound quality test due to some defective component thereof, the manufacturer needs only to loosen the fastening elements 4 and replaces the defective component without the need of discarding other workable components. Thus, the problem of discarding a whole set of sound-generating module due to some defective component as found in the conventional headphones can be avoided.

While the fastening elements 4, the third mounting holes 30 of the second ring-shaped mounting frame 36, and the fourth mounting holes 20 of the ear cup 2 all are five in number in the illustrated embodiment, it is understood the quantity of the fastening elements 4 and the third and fourth mounting holes 30, 20 can be changed according to actual need.

The sound-generating module 3 can further include a cable organizer 37, which is fixed to the second ring-shaped mounting frame 36 via a fastening element 371. With the cable organizer 37, a signal cable (not shown) intended for headphones can be held to the second ring-shaped mounting frame 36 and directly connected to electric contacts 311, 351, 322 on the first perforated plate 31, the second perforated plate 35 and the first ring-shaped spacer 32, respectively.

The diaphragm assembly 33 included in the sound-generating module 3 includes a diaphragm 331 and a first ring-shaped mounting frame 332, which are assembled to each other by, for example, bonding, fastening or ultrasonic welding.

The first ring-shaped spacer 32 included in the sound-generating module 3 includes a plurality of first mounting holes 321, and the first ring-shaped mounting frame 332 includes a plurality of second mounting holes 333. The fastening elements 4 are extended through the third mounting holes 30, the second mounting holes 333, the first mounting holes 321 and the fourth mounting holes 20 to secure the sound-generating module 3 to the ear cup 2. Thus, by providing the first ring-shaped spacer 32 with first mounting holes 321 and the first ring-shaped mounting frame 332 with second mounting holes 333, the sound-generating module 3 can be more tightly and stably secured to the ear cup 2 using the fastening elements 4. The first and the second mounting holes 321, 333 are provided in number corresponding to the third and the fourth mounting holes 30, 20; that is, five in the illustrated embodiment.

The diaphragm 331 in the sound-generating module 3 has a thickness ranged between 1 μm and 100 μm. And, the fastening elements 4 can be screws or other elements with fastening function.

Figure 4:
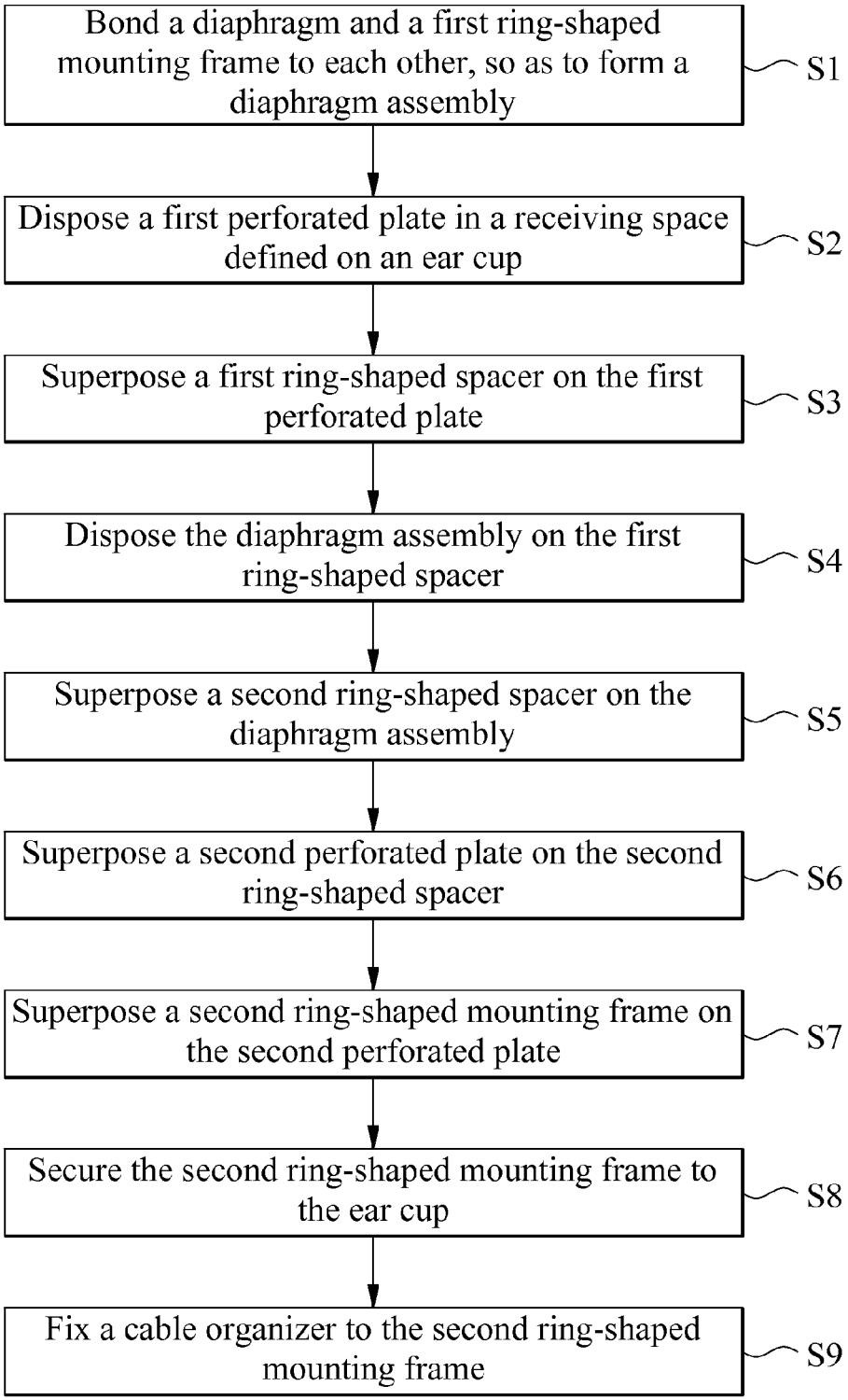
FIG. 4 is a flowchart showing the steps included in a method according to the present invention for assembling the headphone sound-generating structure shown in FIGS. 1 to 3.

FIG. 4 is a flowchart showing the steps included in a method according to the present invention for assembling the above-described headphone sound-generating structure 1; and FIGS. 5 to 10 illustrate different steps of assembling the headphone sound-generating structure 1 according to the method of the present invention. Please refer to FIGS. 1 to 10 at the same time.

Figure 6:
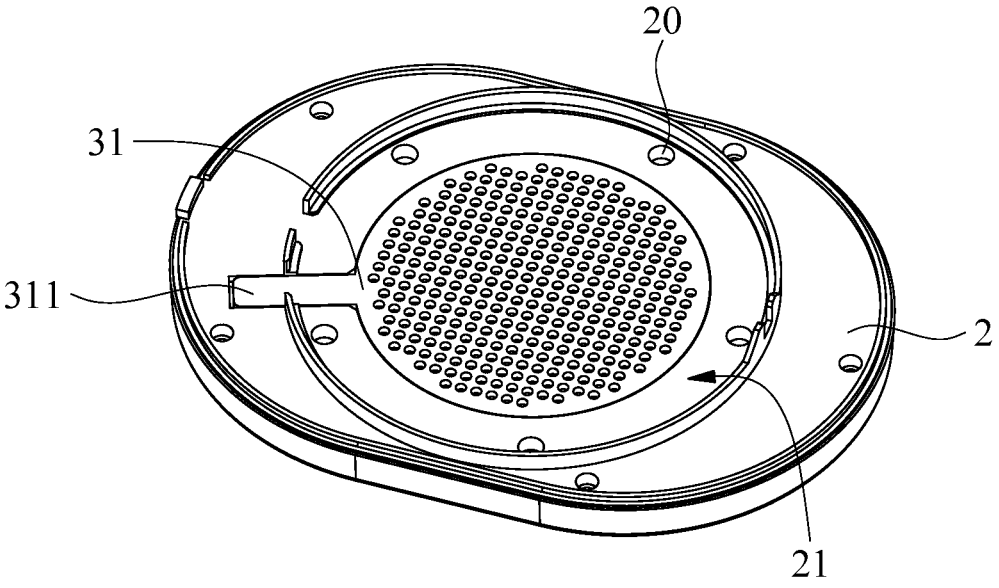
Figure 7:
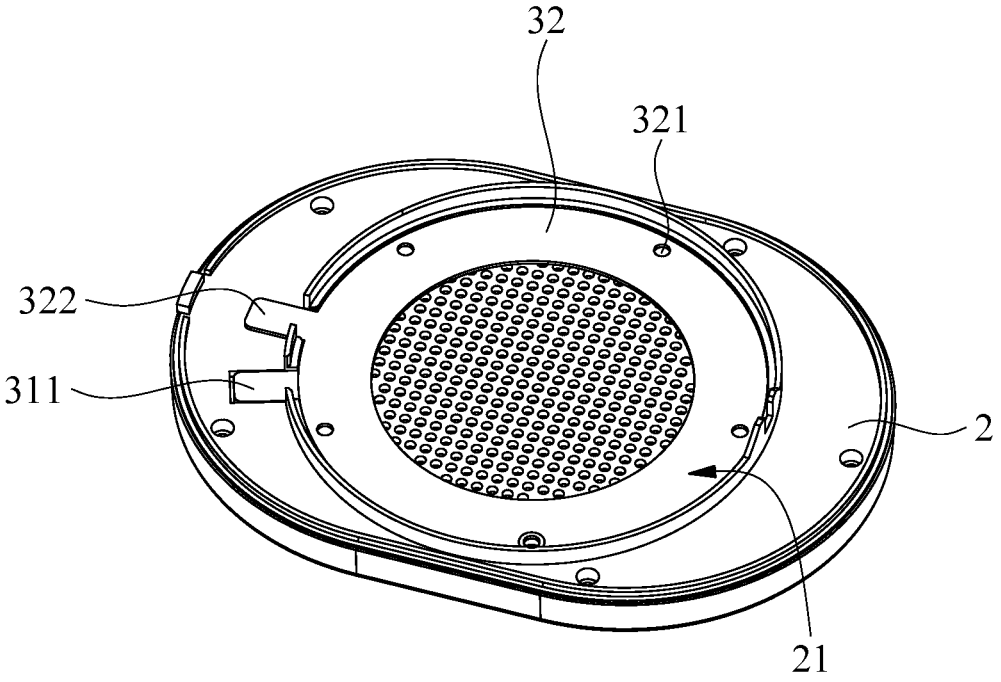
Figure 8:
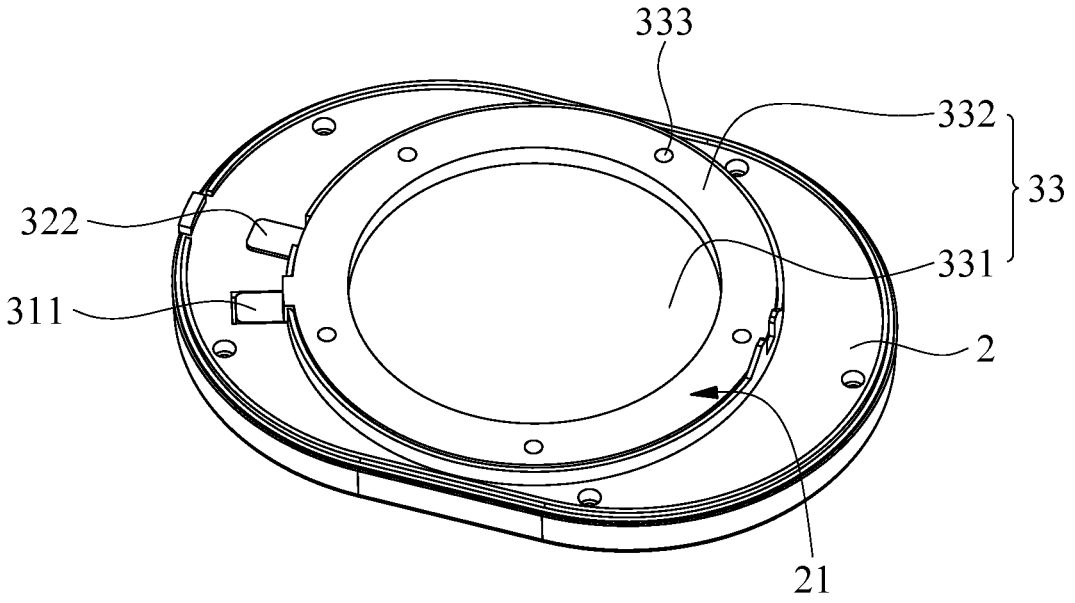
Figure 9:
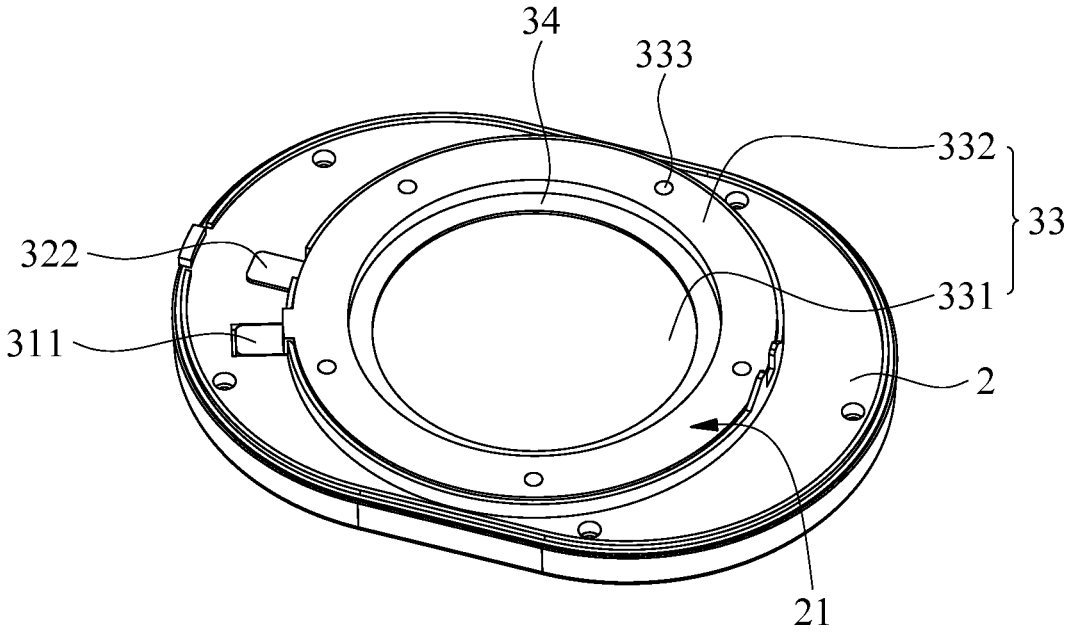
Figure 10:
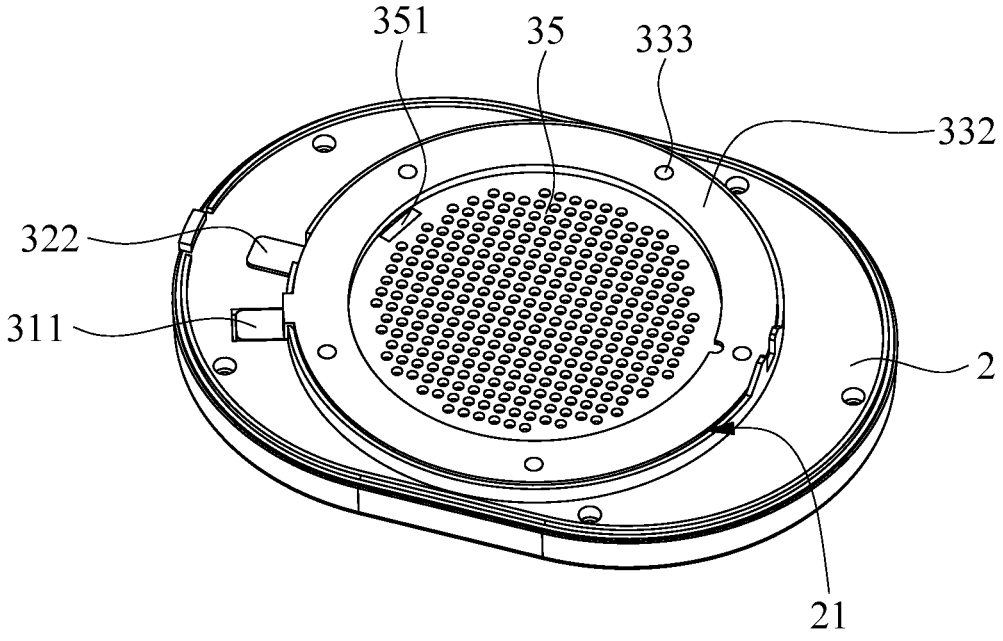

To assemble the headphone sound-generating structure 1, first dispose the first perforated plate 31 on the ear cup 2 in the receiving space 21 thereof (Step S2), as shown in FIG. 6. Then, superpose the first ring-shaped spacer 32 on the first perforated plate 31 (Step S3), as shown in FIG. 7. Thereafter, superpose the diaphragm assembly 33 on the first ring-shaped spacer 32 (Step S4), as shown in FIG. 8; and superpose the second ring-shaped spacer 34 on the diaphragm assembly 33 (Step S5), as shown in FIG. 9. More specifically, the second ring-shaped spacer 34 is superposed on the diaphragm 331 of the diaphragm assembly 33 and is located inside the first ring-shaped mounting frame 332. Then, superpose the second perforated plate 35 on the second ring-shaped spacer 34 (Step S6), as shown in FIG. 10. More specifically, the second perforated plate 35 is superposed on the second ring-shaped spacer 34 and is located inside the first ring-shaped mounting frame 332. Finally, superpose the second ring-shaped mounting frame 36 on the second perforated plate 35 (Step S7), as shown in FIG. 2. More specifically, the second ring-shaped mounting frame 36 is superposed on the second perforated plate 35 and the first ring-shaped mounting frame 332 of the diaphragm assembly 33. Finally, use the fastening elements 4 to secure the second ring-shaped mounting frame 36 to the ear cup 2 (Step S8) and complete the headphone sound-generating structure 1 shown in FIG. 2.

The assembling method according to the present invention may further include a step of fixing a cable organizer 37 to the second ring-shaped mounting frame 36 (Step S9), as shown in FIG. 2. The cable organizer 37 is held to the second ring-shaped mounting frame 36 via a fastening element 371, which can be a screw or other element with fastening function.

Figure 5:
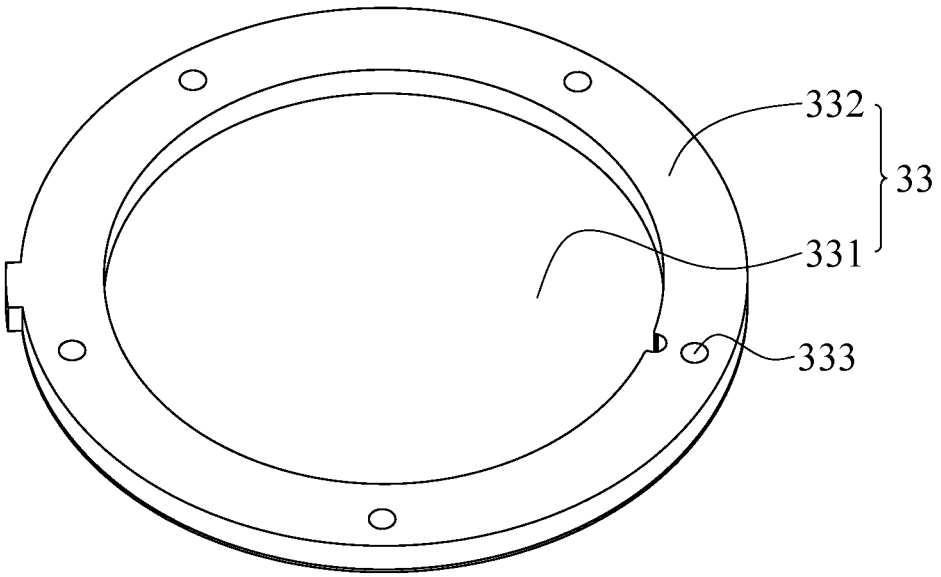
FIGS. 5 to 10 illustrate the steps of assembling the headphone sound-generating structure of the present invention.

Further, according to the assembling method of the present invention, before the step S2 of disposing the first perforated plate 31 in the receiving space 21 of the ear cup 2, a Step S1 can be first performed to bond the diaphragm 331 to the first ring-shaped mounting frame 332 to provide the diaphragm assembly 33, as shown in FIG. 5.

The fully assembled headphone sound-generating structure 1 can be then further assembled or mounted to other related headphone components, such as another ear cup (not shown).

In the case of DC-bias voltage headphones, the first ring-shaped spacer 32 in the sound-generating module 3 is made of an electrically conductive material to have, for example, one conductive side for contacting with a conductive side of the diaphragm 331. On the other hand, in the case of electret headphones, the first ring-shaped spacer 32 does not need to be electrically conductive. In the case of a first ring-shaped spacer 32 made of an electrically conductive material, a DC bias voltage input to the sound-generating module 3 from an external power source can distribute charges on the whole diaphragm 331 via the conductive first ring-shaped spacer 32, so that the diaphragm 331 forms an electrically charged diaphragm. Further, the first ring-shaped spacer 32 has a thickness large enough to create a space between the diaphragm 331 and the first perforated plate 31, so that the diaphragm 331 can be freely actuated by electrostatic forces to vibrate within the space. Similarly, the second ring-shaped spacer 34 also creates another space between the diaphragm 331 and the second perforated plate 35, and the diaphragm 331 can be freely actuated within that space.

The first perforated plate 31 and/or the second perforated plate 35 in the sound-generating module 3 can respectively be an electrically conductive material or a non-conductive material coated with an electrically conductive layer. Further, when the diaphragm 331 is driven to vibrate and forces air through perforations on the first and the second perforated plate 31, 35, sound is produced. In the illustrated embodiment of the present invention, the first and second perforated plates 31, 35 can be substrates made of copper foil or aluminum without being limited thereto. Any electrically conductive materials can be used to make the first and second perforated plates.

Alternatively, the second ring-shaped spacer 34 and the first ring-shaped mounting frame 332 can be injection-molded to form an integral body.

In the case of DC-bias voltage headphones, the electric contact 311 on the first perforated plate 31 and the electric contact 351 on the second perforated plate 35 are respectively connected to an external AC signal; and the electric contact 322 on the first ring-shaped spacer 32 is connected to a DC bias voltage input from an external power source. On the other hand, in the case of electret headphones, the electric contact 322 on the first ring-shaped spacer 32 needs not to be connected to any external electric signal.

In the case of DC-bias voltage electrostatic headphones, the diaphragm 331 in the sound-generating module 3 can be made of a polymeric material frequently used to make the diaphragm for general speakers, including, but not limited to, polyethylene terephthalate (PET), poly(ethylene glycol)2, 6-naphthalate (PEN), poly(ether-imide) (PEI), polycarbonate (PC), and polyphenylene sulfide (PPS). The diaphragm made of any of the above materials must be coated with an electrically conductive layer on one or both sides. In the illustrated embodiment of the present invention, only one side of the diaphragm 331 is coated with an electrically conductive layer. In practical implementation of the present invention, the diaphragm 331 may be PPS or PET coated with gold, aluminum or nickel without being limited thereto. On the other hand, in the case of electret electrostatic headphones, since the material for forming the diaphragm 331 in the sound-generating module 3 must be able to always hold electrostatic charges thereto, the diaphragm 331 may be made of one single layer or multiple layers of dielectric materials that internally include a plurality of nanopores or micropores. The dielectric materials for forming the diaphragm 331 of the electret headphones can be selected from the group consisting of fluorinated ethylene propylene (FEP), polytetrafluoroethylene (PTFE), expanded polytetrafluoroethylene (e-PTFE), polyvinylidene fluoride (PVDF), and some fluorine-contained polymers. In the illustrated embodiment of the present invention, the diaphragm 331 for the electret headphones is made of e-PTFE.

With the above arrangements, the present invention is novel and improved because it provides a headphone sound-generating structure including components that can be quickly assembled together using fastening elements to enable lowered manufacturing cost, increased good yield and convenient maintenance thereof without causing waste of any material. The present invention is also industrially practical for use because products derived from the present invention would no doubt meet the current market demands.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A headphone sound-generating structure configured for mounting in a receiving space defined on an ear cup having a plurality of fourth mounting holes, comprising:

a sound-generating module including a first perforated plate, a first ring-shaped spacer, a diaphragm assembly, a second ring-shaped spacer, a second perforated plate, and a second ring-shaped mounting frame, which are sequentially superposed in the receiving space defined on the ear cup; and the second ring-shaped mounting frame being provided with a plurality of third mounting holes, wherein the diaphragm assembly includes a diaphragm and a first ring-shaped mounting frame connected to each other, the second ring-shaped spacer is disposed on the diaphragm and is located inside the first ring-shaped mounting frame, the second perforated plate is disposed on the second ring-shaped spacer and is located inside the first ring-shaped mounting frame; and a plurality of fastening elements being extended through the third mounting holes and the fourth mounting holes to secure the sound-generating module to the ear cup.

2. The headphone sound-generating structure as claimed in claim 1, wherein the first ring-shaped spacer is provided with a plurality of first mounting holes, and the first ring-shaped mounting frame is provided with a plurality of second mounting holes; the fastening elements being extended through the third, the second and the first mounting holes into the fourth mounting holes to secure the sound-generating module to the ear cup.

3. The headphone sound-generating structure as claimed in claim 1, wherein the second ring-shaped spacer and the first ring-shaped mounting frame are integrally molded.

4. The headphone sound-generating structure as claimed in claim 1, wherein the diaphragm is made of a material selected from the group consisting of polyethylene terephthalate (PET), poly(ethylene glycol)2, 6-naphthalate (PEN), poly (ether-imide) (PEI), polycarbonate (PC), and polyphenylene sulfide (PPS) in the case the headphone sound-generating structure is configured for DC-bias voltage headphones; and the diaphragm is made of a material selected from the group consisting of fluorinated ethylene propylene (FEP), polytetrafluoroethylene (PTFE), expanded polytetrafluoroethylene (e-PTFE), polyvinylidene fluoride (PVDF), and some fluorine-contained polymers in the case the headphone sound-generating structure is configured for electret headphones.

5. A method of assembling headphone sound-generating structure, comprising the following steps: disposing a first perforated plate in a receiving space defined on an ear cup; bonding a diaphragm and a first ring-shaped mounting frame to each other to form a diaphragm assembly; superposing a first ring-shaped spacer on the first perforated plate; superposing the diaphragm assembly on the first ring-shaped spacer; superposing a second ring-shaped spacer on the diaphragm assembly, the second ring-shaped spacer is disposed on the diaphragm and is located inside the first ring-shaped mounting frame; superposing a second perforated plate on the second ring-shaped spacer, the second perforated plate is disposed on the second ring-shaped spacer and is located inside the first ring-shaped mounting frame; superposing a second ring-shaped mounting frame on the second perforated plate; and using a plurality of fastening elements to secure the second ring-shaped mounting frame to the ear cup.

6. The assembling method as claimed in claim 5, wherein, in the step of superposing the second ring-shaped mounting frame on the second perforated plate, the second ring-shaped mounting frame is disposed on the second perforated plate and the first ring-shaped mounting frame of the diaphragm assembly.

* * * * *